US011022324B2

(12) United States Patent
Jeong et al.

(10) Patent No.: US 11,022,324 B2
(45) Date of Patent: Jun. 1, 2021

(54) COOKING APPLIANCE AND COMBUSTION CONTROL METHOD OF A COOKING APPLIANCE

(71) Applicant: LG ELECTRONICS INC., Seoul (KR)

(72) Inventors: Jeonghoon Jeong, Seoul (KR); Daebong Yang, Seoul (KR); Dongjae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 302 days.

(21) Appl. No.: 16/014,919

(22) Filed: Jun. 21, 2018

(65) Prior Publication Data

US 2019/0003724 A1 Jan. 3, 2019

(30) Foreign Application Priority Data

Jun. 30, 2017 (KR) ..... 10-2017-0083901

(51) Int. Cl.
*F24C 15/32* (2006.01)
*F24C 7/08* (2006.01)
*F24C 15/20* (2006.01)

(52) U.S. Cl.
CPC ..... *F24C 15/325* (2013.01); *F24C 7/087* (2013.01); *F24C 15/2007* (2013.01); *F24C 15/2021* (2013.01); *F24C 15/322* (2013.01)

(58) Field of Classification Search
CPC . F24C 15/325; F24C 15/2021; F24C 15/2007
USPC ..... 126/21 A; 219/392, 400, 757
See application file for complete search history.

(56) References Cited

U.S. PATENT DOCUMENTS 1,431,953 A 10/1922 Henoch
2,798,930 A * 7/1957 Frost ..... F24C 15/102 219/392
3,828,760 A 8/1974 Farber
3,889,581 A 6/1975 Bray, Sr.
4,108,139 A 8/1978 Gillionn
4,144,870 A 3/1979 Reynolds
4,354,084 A 10/1982 Husslein et al.
4,516,012 A 5/1985 Smith
(Continued)

FOREIGN PATENT DOCUMENTS

CH 703 729 2/2012
DE 297 03 147 4/1997
(Continued)

OTHER PUBLICATIONS

United States Office Action dated Jun. 10, 2020 issued in U.S. Appl. No. 16/017,263.
(Continued)

*Primary Examiner* — Thien S Tran
(74) *Attorney, Agent, or Firm* — Ked & Associates LLP

(57) ABSTRACT

A cooking appliance is provided that may include a main body having a cooking chamber formed therein; a first heating assembly provided inside the cooking chamber and configured to generate heat; a second heating assembly provided outside the cooking chamber and configured to generate heat under the cooking chamber; and a flow path connection member configured to form a path through which the heat generated in the second heating assembly is introduced into the cooking chamber.

11 Claims, 10 Drawing Sheets

(56) References Cited

U.S. PATENT DOCUMENTS

| | | | |
|---|---|---|---|
| 4,601,279 | A | 7/1986 | Guerin |
| 4,829,158 | A | 5/1989 | Burnham |
| 4,964,392 | A | 10/1990 | Bruno et al. |
| 5,361,749 | A | 11/1994 | Smith, Jr. |
| 5,460,157 | A | 10/1995 | Prabhu |
| 5,492,055 | A | 2/1996 | Nevin |
| 5,655,511 | A | 8/1997 | Prabhu |
| 5,816,234 | A | 10/1998 | Vasan |
| 6,124,572 | A | 9/2000 | Spilger et al. |
| 6,307,185 | B1 | 10/2001 | Loveless |
| 7,060,940 | B2 | 6/2006 | Kim |
| 7,372,000 | B2 | 5/2008 | Stockley |
| 8,709,905 | B2 | 4/2014 | Crayfourd |
| 9,404,660 | B1 | 8/2016 | Karabin |
| 9,939,161 | B2 | 4/2018 | Jeong et al. |
| 2002/0092842 | A1 | 7/2002 | Loveless |
| 2004/0129692 | A1 | 7/2004 | Kim |
| 2006/0131298 | A1* | 6/2006 | Seuk Oh ..... F24C 15/325 219/400 |
| 2007/0108179 | A1 | 5/2007 | Hines, Jr. |
| 2007/0131220 | A1 | 6/2007 | Kim |
| 2007/0295706 | A1 | 12/2007 | Brun |
| 2008/0223843 | A1 | 9/2008 | White |
| 2009/0065493 | A1 | 3/2009 | Hines, Jr. |
| 2011/0049124 | A1 | 3/2011 | Crayfourd |
| 2012/0080419 | A1 | 4/2012 | Bush |
| 2013/0255655 | A1 | 10/2013 | Johnson |
| 2013/0323663 | A1 | 12/2013 | Harward et al. |
| 2014/0137853 | A1 | 5/2014 | Murray |
| 2014/0283814 | A1 | 9/2014 | Armstrong |
| 2016/0003384 | A1 | 1/2016 | Fischer |
| 2016/0204676 | A1 | 7/2016 | Ziegler |
| 2016/0320072 | A1 | 11/2016 | Colozzo et al. |
| 2017/0118798 | A1 | 4/2017 | Johnson et al. |
| 2017/0292713 | A1 | 10/2017 | Boedicker |
| 2018/0184488 | A1 | 6/2018 | Lee |
| 2018/0347828 | A1 | 12/2018 | Seok |

FOREIGN PATENT DOCUMENTS

| | | | |
|---|---|---|---|
| DE | 203 21 203 | | 6/2006 |
| EP | 0 628 772 | | 12/1994 |
| EP | 0 860 658 | | 8/1998 |
| EP | 1 312 293 | | 5/2003 |
| EP | 1 674 796 | | 6/2006 |
| EP | 1674796 | A2 * | 6/2006 |
| EP | 2 610 557 | | 7/2013 |
| EP | 2610557 | A1 * | 7/2013 |
| FR | 2653209 | | 4/1991 |
| GB | 1183203 | | 3/1970 |
| KR | 20-1998-0029343 | | 8/1998 |
| KR | 10-2006-0070910 | | 6/2006 |
| KR | 10-2016-0084273 | | 7/2016 |
| WO | WO 2008/112855 | | 9/2008 |
| WO | WO 2015/092640 | | 6/2015 |

OTHER PUBLICATIONS

European Search Report dated Nov. 15, 2018 issued in EP Application No. 18180283.6.
European Search Report dated Nov. 19, 2018 issued in EP Application No. 18180284.4.
European Search Report dated Nov. 21, 2018 issued in EP Application No. 18180288.5.
European Office Action dated Oct. 16, 2019 issued in Application No. 18 180 283.6.
Korean Notice of Allowance dated Aug. 27, 2018 issued in Application No. 10-2017-0083902.
Korean Notice of Allowance dated Aug. 28, 2018 issued in Application No. 10-2017-0083901.
U.S. Appl. No. 16/014,919, filed Jun. 21, 2018.
U.S. Appl. No. 16/017,263, filed Jun. 25, 2018.
U.S. Appl. No. 16/017,446, filed Jun. 25, 2018.
United States Office Action dated Jul. 20, 2020 issued in U.S. Appl. No. 16/017,446.

* cited by examiner

COOKING APPLIANCE AND COMBUSTION CONTROL METHOD OF A COOKING APPLIANCE

CROSS-REFERENCE TO RELATED APPLICATION(S)

This application claims priority to and the benefit of Korean Patent Application No. 10-2017-0083901, filed in Korea on Jun. 30, 2017, the disclosure of which is incorporated herein by reference in its entirety.

BACKGROUND

1. Field

A cooking appliance and combustion control method of a cooking appliance are disclosed herein.

2. Background

A cooking appliance may be a household appliance used to cook food or other items (hereinafter "food") and may be installed in a space in a kitchen to cook food according to a user's intention. Such a cooking appliance may be classified into various types of cooking appliances depending on a heating source, a shape, or a fuel type to be used.

For example, a cooking appliance may be classified into an open-type cooking appliance and a sealed-type cooking appliance depending on a shape in which food is cooking, that is, a shape of space where foods are placed. Sealed-type cooking appliances may include an oven, a microwave oven, and the like, and open-type cooking appliances may include a cooktop, a hob, and the like.

A sealed-type cooking appliance may be a cooking appliance that shields a space where food is placed and cooks food by heating the shielded space. The sealed-type cooking appliance may include a cooking chamber, which is a space to be shielded when food is placed and cooked therein. Such a cooking chamber may be a space where food is substantially cooked.

A door to selectively open and close the cooking chamber may be rotatably provided in a sealed-type cooking appliance. The door may be rotatably installed on a main body by a door hinge provided between the main body having the cooking chamber formed therein and the door. That is, the door may selectively open and close the cooking chamber by being rotated around a portion coupled to the main body by the door hinge.

A heating source may be provided in an inner space of the cooking chamber, which is opened and closed by the door, to heat the cooking chamber. A gas burner, an electric heater, or the like may be used as the heating source.

In a sealed-type cooking appliance in which a gas burner is used as a heating source, a plurality of burners may be provided to heat food inside a cooking chamber. For example, a broil burner may be installed on an upper portion of a cooking chamber, and a bake burner may be installed on a lower portion or at a rear of the cooking chamber.

Also, a convection device may be further provided at the rear of the cooking chamber. The convection device may circulate air inside the cooking chamber so that heat is uniformly distributed throughout the cooking chamber, and may include a fan cover installed on a rear wall of the cooking chamber and a convection fan installed in an inner space of the fan cover.

A suction port and a discharge port may be provided inside the fan cover, and the suction port may be formed in the center of a front surface of the fan cover facing the door, and the discharge port may be formed in a side surface of the fan cover facing a side surface of the cooking chamber. The convection fan may be rotated inside the fan cover to generate airflow. Accordingly, the convection fan may generate an air circulation flow so that air in the cooking chamber is introduced into the fan cover through the suction port and air heated inside the fan cover is discharged to the cooking chamber through the discharge port.

A cooking appliance having a bake burner may be divided into a probake type cooking appliance and a bottom bake type cooking appliance according to the installation form of the bake burner. The probake type cooking appliance may be configured such that a bake burner is installed in the rear of the cooking chamber, more specifically inside a convection device. In the probake type cooking appliance, heat may be generated inside the convection device by the combustion of the bake burner, and the generated heat may be circulated inside a fan cover and may be evenly distributed throughout the cooking chamber by the operation of a convection fan that generates airflow.

That is, the probake type cooking appliance may evenly distribute heat generated in the bake burner to the entire cooking chamber by the operation of the convection fan installed inside the convection device, thereby uniformly heating food in the cooking chamber.

Accordingly, the probake type cooking appliance may uniformly heat the food in the cooking chamber. However, the probake type cooking appliance may have a disadvantage in that it may be difficult to implement a function of applying concentrated heating to a specific part of a food, for example applying concentrated heating to the bottom surface of food so that the bottom surface of food such as pizza is cooked to a more crispy form.

Compared to the probake type cooking appliance, a bottom bake type cooking appliance may be configured such that a bake burner is installed under the cooking chamber. Such a bottom bake type cooking appliance may apply concentrated heating to the bottom surface of food by allowing heat generated in the bake burner to be transferred to the lower portion of the food in the cooking chamber, but may have a disadvantage in that it may be difficult to uniformly heat the food in the cooking chamber.

BRIEF DESCRIPTION OF THE DRAWINGS

Embodiments will be described in detail with reference to the following drawings in which like reference numerals refer to like elements, and wherein.

DETAILED DESCRIPTION

Figure 1:
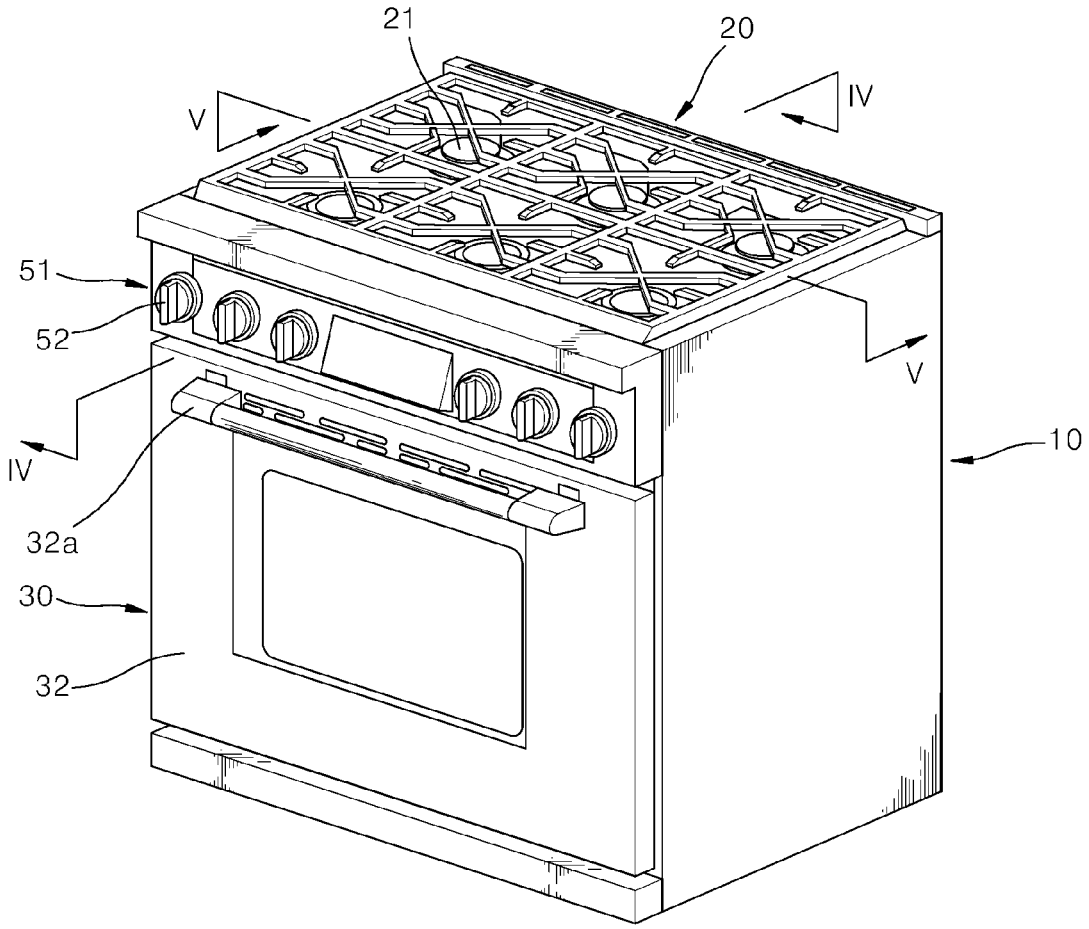
FIG. 1 is a perspective view illustrating a cooking appliance according to an embodiment.

Hereinafter, an embodiment of a cooking appliance and a combustion control method thereof according to the present disclosure will be described with reference to the accompanying drawings. For convenience of descriptions, thicknesses of lines and sizes of components shown in the drawings may be exaggerated. In addition, the terms described below are defined in consideration of functions of the present disclosure, which may vary depending on the intention of a user or operator, or custom. Therefore, the definitions of the terms should be based on contents throughout this specification.

Figure 2:
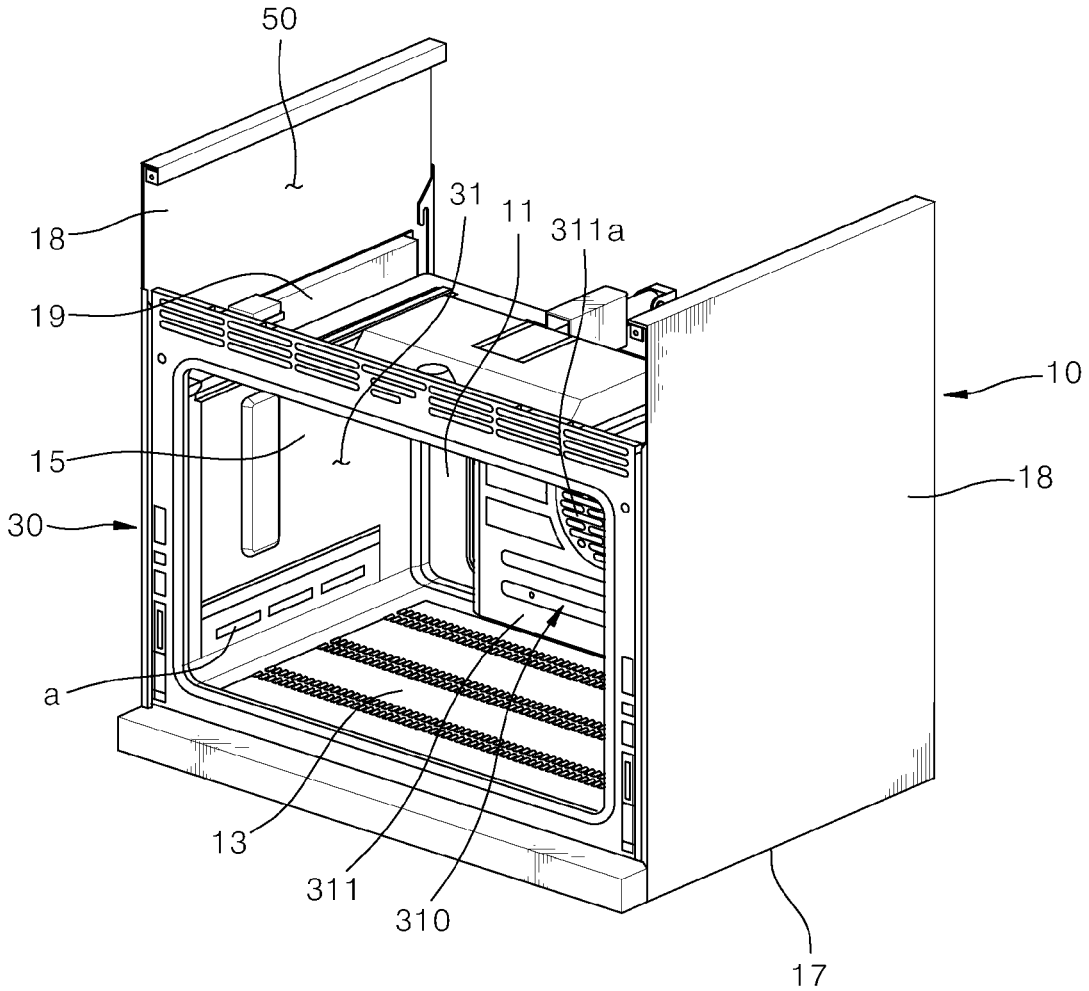
FIG. 2 is a perspective view illustrating an oven separated from the cooking appliance illustrated in FIG. 1.

FIG. 1 is a perspective view illustrating a cooking appliance according to an embodiment. FIG. 2 is a perspective view illustrating an oven separated from the cooking appliance illustrated in FIG. 1. Referring to FIGS. 1 and 2, an exterior of the cooking appliance according to an embodiment may be formed by a main body 10. The main body 10 may have an approximately rectangular shape and may be formed of a material having a predetermined strength to protect a plurality of parts installed in an inner space of the main body 10.

A cooktop unit (or cooktop) 20 may be provided on an upper end portion of the main body 10, which is an open space, and food or a container filled with food placed thereon may be heated by the cooktop 20 to cook the food. At least one cooktop heater 21 configure to heat food or a container filled with food to be cooked may be provided in the cooktop 20.

Also, an oven unit (or oven) 30 may be installed under the cooktop 20. A cooking chamber 31 may be provided in an inner space of the oven 30 to provide a space where food is cooked.

The cooking chamber 31 may have a hexahedral shape of which a front surface is open, and the inner space of the cooking chamber 31 may be heated to cook the food while the cooking chamber 31 is shielded. That is, in the oven 30, the inner space of the cooking chamber 31 may be a space in which the food is actually cooked.

A door 32 that selectively opens and closes the cooking chamber 31 may be rotatably provided on the oven 30. The door 32 may open and close the cooking chamber 31 in a pull-down manner in which an upper end thereof is rotated up and down around a lower end thereof.

The door 32 may be formed in a hexahedral shape having a predetermined thickness, and a handle 32*a* may be installed on a front surface of the door 32 so that a user may grip the handle 32*a* to rotate the door 32. The user may easily rotate the door 32 using the handle 32*a*.

A control panel 51 may be provided at a front surface of the cooktop 20, i.e., above the door 32. The control panel 51 may have a hexahedral shape having a predetermined inner space, and an input unit (or input) 52 may be provided on a front surface of the control panel 51 for the user to input operational signals to operate the cooktop 20 and the oven 30.

A plurality of operational switches may be provided in or at the input 52 and the user may directly input operational signals using the operational switches. Also, the control panel 51 may further include a display part (or display) to provide the user with information on the operation of the cooking appliance or information on food being cooked, and thus the user may check various types of information on a shelf supporter and the cooking appliance including the shelf supporter through the display. A machine room 50 configured to provide a space in which electrical components are located may be formed in or at an inner space of the main body 10, i.e., in a space between the cooktop 20 and the oven 30. The control panel 51 may be provided on a front surface of the machine room 50 so that the control panel 51 substantially covers the front surface of the machine room 50.

Figure 3:
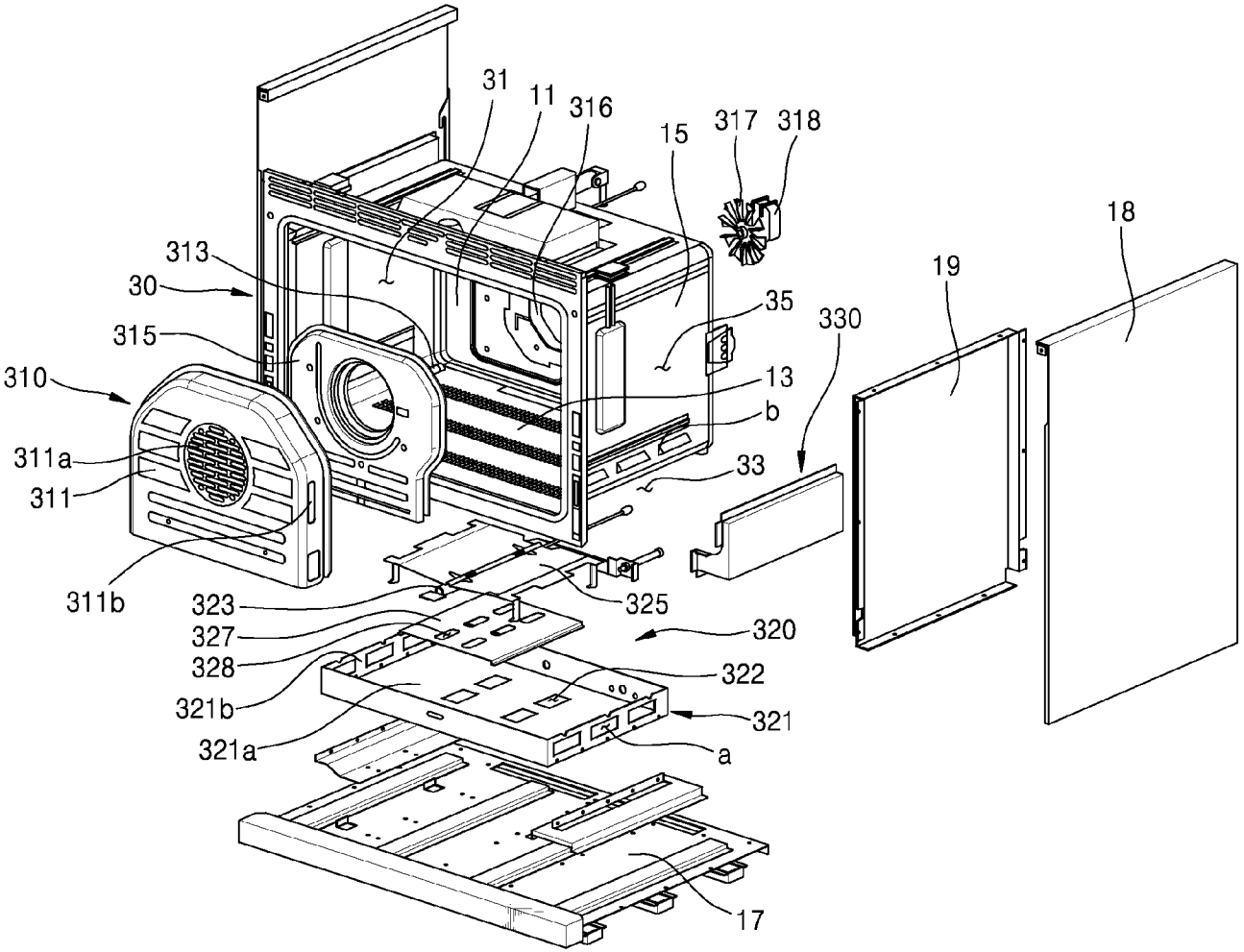
FIG. 3 is an exploded perspective view illustrating components of the oven of the cooking appliance illustrated in FIG. 1.
Figure 4:
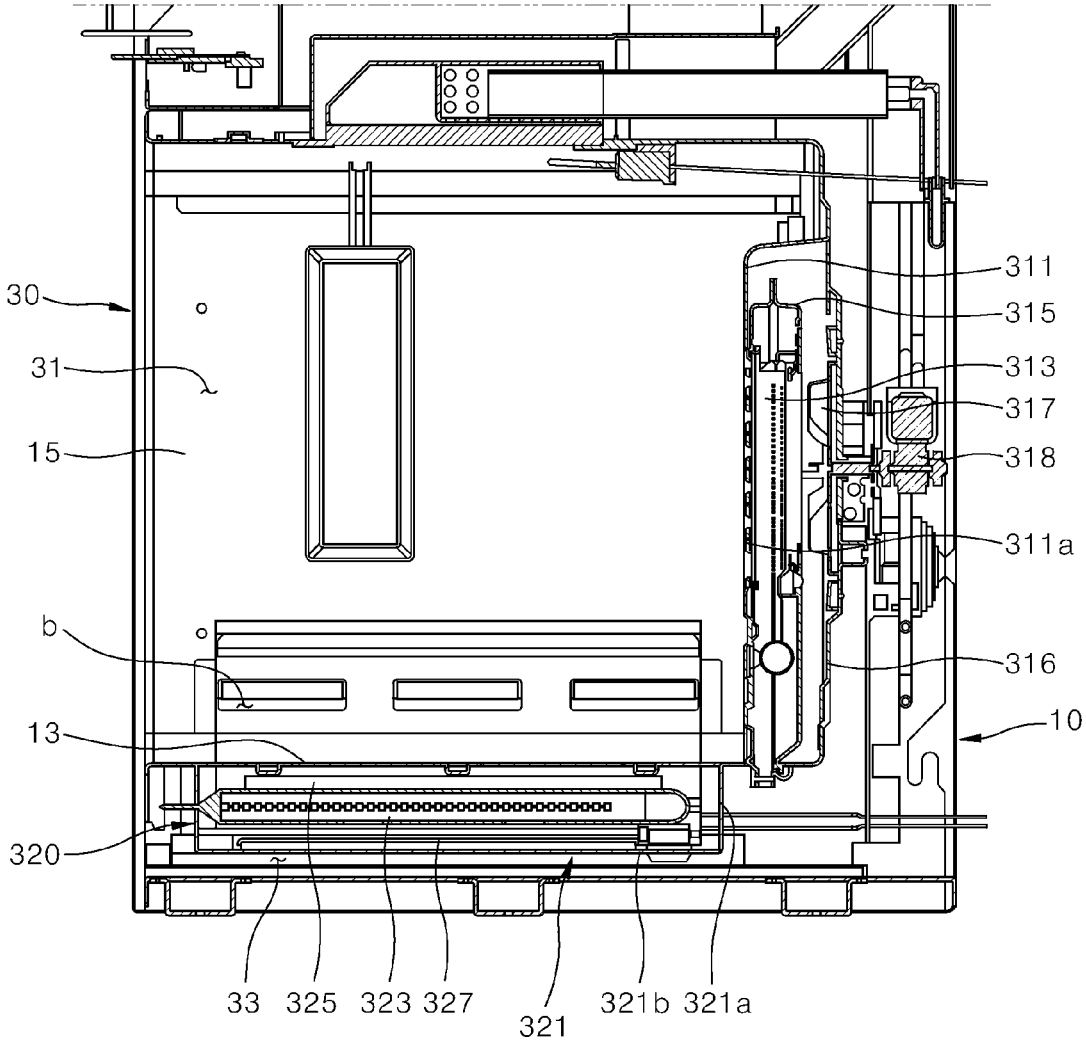
FIG. 4 is a cross-sectional view taken along line "IV-IV" in FIG. 1.
Figure 5:
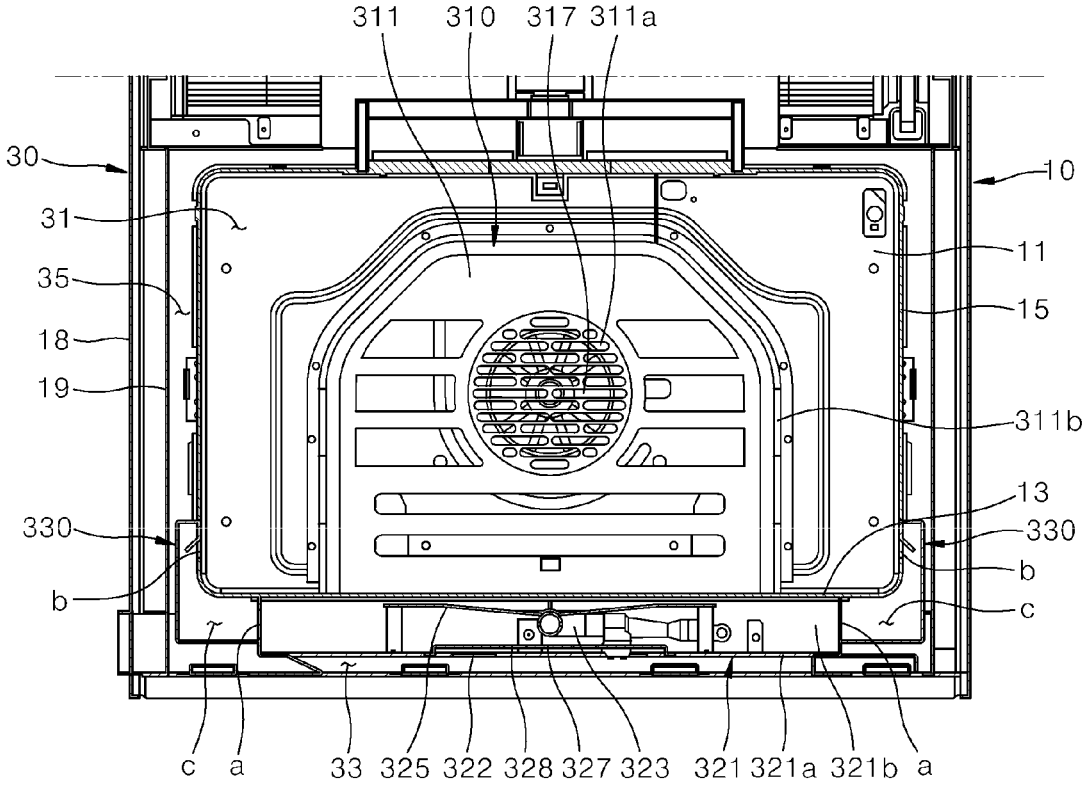
FIG. 5 is a cross-sectional view taken along line "V-V" in FIG. 1.

FIG. 3 is an exploded perspective view illustrating components of an oven of a cooking appliance illustrated in FIG. 1, FIG. 4 is a cross-sectional view taken along line "IV-IV" in FIG. 1, and FIG. 5 is a cross-sectional view taken along line "V-V" in FIG. 1. Referring to FIGS. 3 to 5, the oven 30 of the cooking appliance according to one embodiment of the present disclosure may include a main body 10 configured to form a frame of the oven 30, a door 32 installed in front of the main body 10 to open and close a cooking chamber 31, a first heating unit (or first heating assembly) 310 installed inside the cooking chamber 31, and a second heating unit (or second heating assembly) 320 installed below an outer side of the cooking chamber 31.

According to the embodiment, the main body 10 may have an approximately rectangular shape, and may include a rear surface unit (or rear surface) 11, a lower surface unit (or lower surface) 13, and a side surface unit (or side surface) 15.

The rear surface 11 may be a wall surface located behind the cooking chamber 31 and may define a rear boundary surface of the cooking chamber 31 formed inside the main body 10. The rear surface 11 may form a rear surface of the cooking chamber 31 and may form the wall surface on which a fan cover 311 of the first heating assembly 310 is installed so that the first heating assembly 310 is located behind the cooking chamber 31.

The lower surface 13 may be a wall surface located on a lower side of the cooking chamber 31 and may define a lower boundary surface of the cooking chamber 31 that is formed inside the main body 10. The lower surface 13 may form a lower surface of the cooking chamber 31 and may form a boundary surface configured to divide an inner space of the main body 10 into the cooking chamber 31 and a lower space portion 33 which will be described below.

The side surface 15 may be a wall surface located at a side of the cooking chamber 31 and may define a side boundary surface of the cooking chamber 31 formed inside the main body 10. The side surface 15 may form a side surface of the cooking chamber 31 and may form a boundary surface configured to divide the inner space of the main body 10 into the cooking chamber 31 and a side space portion 35 which will be described below.

The lower space portion 33 and the side space portion 35 in addition to the cooking chamber 31 may be formed inside the main body 10. The lower space portion 33 may be formed inside of the main body 10 and below the outer side of the cooking chamber 31 so that a space separated from the cooking chamber 31 may be formed between a bottom of the main body 10 and the cooking chamber 31. The cooking chamber 31 and the lower space portion 33 may be divided by the lower surface 13, and the lower space portion 33 formed as described above may be a space in which the second heating assembly 320 and a part of the flow path connection member 330 which will be described below may be installed.

The side space portion 35 may be formed inside the main body 10 and beside the outer side of the cooking chamber 31 so that a space separated from the cooking chamber 31 is formed beside the cooking chamber 31. The cooking chamber 31 and the side space portion 35 may be divided by the side surface 15, and the side space portion 35 formed as described above may be a space in which a part of a flow path connection member 330 and other parts related to the oven 30 which will be described below may be installed. The side space portions 35 may be formed from the cooking chamber 31 to both sides of the main body 10.

In addition, the main body 10 may further include a bottom unit (or bottom panel) 17 and side panel units (or side panels) 18 and 19. The bottom panel 17 may be provided at the lower portion of the main body 10 to form a bottom surface of the main body 10 and may define a lower boundary surface of the lower space portion 33 that is formed inside the main body 10.

Also, the side panels 18 and 19 may be installed beside both sides of the main body 10 to form side surfaces of the outer side of the main body 10 and may define boundary surfaces of the outer side of the side space portions 35 formed inside the main body 10.

According to the embodiment, the side space portions 35 may be formed at both sides of the cooking chamber 31 in a lateral direction, and each side space portion 35 may form a space in which the side space portion 35 is surrounded by the main body 10 in the form of a "⊏" shape when viewed from the top, i.e., three portions thereof may be surrounded by the main body 10 and the remaining portion may be open in an outward direction.

The side panels 18 and 19 may be installed on open portions of the main body 10 as described above to cover open portions of the side space portion 35 from the outside of the main body 10 and may form an exterior of the side surface of the main body 10. The side panels 18 and 19 may include an outer panel 18 and a gasket case 19.

The outer panel 18 may have a shape corresponding to the open shape at one side of the side space portion 35, and may be installed on each side portion of the main body 10. The outer panel 18 may cover the one open portion of the side space portion 35 from the outside and form the exterior of the side surface of the main body 10, and may be installed in a form detachably coupled to each side portion of the main body 10.

The gasket case 19 may be provided between the side surface 15 and the outer panel 18. The gasket case 19 may provide a heat insulating function to block heat generated in the first heating assembly 310 and the second heating assembly 320 respectively installed in the cooking chamber 31 and the lower space portion 33 from being transferred to the outer panel 18. The gasket case 19 may be installed in a fixed or detachably coupled form to the outer panel 18.

The side panels 18 and 19 provided as described above may cover one open portion of the side space portion 35 from the outside to form the exterior of the side surface of the main body 10 when coupled to the side portion of the main body 10, and may be separated from the main body 10, when it is required, to open the inside of the side space portion 35 to the outside of the main body 10. The first heating assembly 310 may be provided inside the cooking chamber 31 to generate heat inside the cooking chamber 31. In the embodiment, the first heating assembly 310 may be provided as a probake burner type. The first heating assembly 310 may generate heat in the cooking chamber 31 and may generate a circulation flow of the heat circulating the inside of the cooking chamber 31 so that the generated heat is uniformly transferred to the cooking chamber 31. A description of a configuration of the first heating assembly 310 will be given below.

The second heating assembly 320 may be provided in the lower portion of the outer side of the cooking chamber 31, more specifically in the lower space portion 33, and may generate heat below the cooking chamber 31. In the embodiment, the second heating assembly 320 may be provided as a bottom bake type. The second heating assembly 320 may generate heat below the cooking chamber 31 and may allow the generated heat to be transferred to the lower portion of food in the cooking chamber 31, thereby implementing a function of applying concentrated heating to the bottom surface of the food. A description of the configuration of the second heating assembly 320 will be described below.

The first heating assembly 310 may be provided inside the cooking chamber 31 and may include a fan cover 311, a first heater 313, a burner cover 315, and a convection fan 317. The fan cover 311 may be installed behind the main body 10, more specifically on the rear surface 11 forming a rear surface of the cooking chamber 31. For example, the fan cover 311 may be formed in a hexahedral shape of which a rear surface is open. The fan cover 311 may be coupled to the rear surface 11 so that the open rear surface of the fan cover 311 is covered by the rear surface 11 to form a separated accommodation space in the cooking chamber 31.

A suction port 311*a* and a discharge port 311*b* may be provided in the fan cover 311. The suction port 311*a* may pass through a front surface of the fan cover 311 toward the front of the cooking chamber 31, and the discharge port 311*b* may pass through a side surface of the cooking chamber 31, that is, through a side surface of the fan cover 311 facing the side surface 15.

A first heater 313 may be provided in the accommodation space inside the fan cover 311 to generate heat. In the embodiment, the first heater 313 may be provided as a probake burner type provided on the rear surface of the cooking chamber 31.

Accordingly, the first heater 313 may be provided in a form in which a plurality of flame holes are formed in a side portion of a burner body, which may include a hollow pipe that extends to form a curved line in a "U" shape. A flow path may be formed in the burner body to supply a mixed gas. Also, the flame holes may form paths, and the gas supplied into the burner body may be discharged to an outside of the burner body through the flame holes. A plurality of flame holes may be provided in or at the side portion of the burner body, and may be spaced apart from each other in an extending direction of the burner body. Thus, a plurality of paths through which the gas may be discharged may be provided in the burner body in the extending direction thereof.

According to the embodiment, a gas mixed with air, which may be a mixed gas, may be supplied to the burner body through a mixing tube connected thereto. Also, the mixed gas supplied to the flow path inside the burner body may be discharged to the outside of the burner body through the flame holes, and may be burned to generate flames outside of the first heater 313, that is, in the accommodation space inside the fan cover 311.

The burner cover 315 may be located in or at the accommodation space inside the fan cover 311, and may have a form in which a pair of cover plates separated from each other in a front-rear direction are coupled to the burner cover 315. In the burner cover 315, the first heater 313 may be accommodated, and flames may be generated in a space around the first heater 313.

The burner cover 315 provided as described above may restrict a region where the flames generated in the first heater 313 are diffused, and thus the flames generated in the first heater 313 may be stabilized. Also, the burner cover 315 may block the flames from coming into direct contact with the wall surfaces of the fan cover 311 and the cooking chamber 31.

The cooking appliance of the embodiment may further include a reflecting plate 316. The reflecting plate 316 may be located in the accommodation space inside the fan cover 311 and between the burner cover 315 and the rear wall of the cooking chamber 31. The reflecting plate 316 may block the heat generated by the flame generated in the first heater 313 from being transferred to the rear wall of the cooking chamber 31 to protect the coating layer, such as enamel, formed on the surface of the cooking chamber 31 from thermal damage.

A convection fan 317 may be located in the accommodation space inside the fan cover 311. The convection fan 317 may be rotated by a convection motor 318 connected to the convection fan 317 to generate an airflow. The convection fan 317 may generate a circulation flow of air such that the air in the cooking chamber 31 is introduced into and heated in the accommodation space inside the fan cover 311 through the suction port 311*a* and discharged to the cooking chamber 31 through the discharge port 311*b*.

The second heating assembly 320 may be formed in a lower portion of a cooking chamber 31 and in a lower space portion 33 formed below the cooking chamber 31, which may be a space separated from the cooking chamber 31 in which the first heating assembly 310 is installed. The second heating assembly 320 may include a lower case 321, a second heater 323, and a guide plate 325.

The lower case 321 may be installed in the lower space portion 33, and an accommodation space in which various components constituting the second heating assembly 320 are installed may be formed in the lower case 321. The lower case 321 may have a rectangular shape and may be formed of a material having a predetermined strength to protect a plurality of parts installed in the accommodation space inside the lower case 321.

The lower case 321 may include a bottom surface unit (or bottom surface) 321*a* configured to form a bottom surface of the lower case 321 and a side wall unit (or side wall) 321*b* that extends upward from the bottom surface 321*a* and forms a side surface of the lower case 321. The second heater 323 may be installed in the accommodation space inside the lower case 321 and may generate heat below the cooking chamber 31. The second heater 323 may be a bottom bake burner type provided below the cooking chamber 31.

The second heater 323 may be provided such that a plurality of flame holes is formed in or at a side portion of a burner body, which may be a hollow pipe that linearly extends in a front-rear direction. As another example, the second heater 323 may be provided such that a plurality of flame holes are formed in or at a side portion of a burner body, which may be a hollow pipe that extends to form a curved line in a "U" shape.

The main differences between the second heater 323 and the first heater 313 may be directions in which the flame holes are formed and locations where the flames are formed. Besides these, there may not be much difference in configuration between the first heater 313 and the second heater 323, so a description of the second heater 323 will be omitted.

A guide plate 325 may be provided above the second heater 323. The guide plate 325 may be arranged between the lower surface 13 and the second heater 323 to block the second heater 323 from the lower surface 13. The guide plate 325 may block flames generated in the second heater 323 from coming into direct contact with the lower surface 13 which may be the bottom surface of the cooking chamber 31 and may allow the heat generated by the combustion of the second heater 323 to be indirectly transferred to the lower surface 13.

The second heating assembly 320 of the embodiment may further include an air guide 327 provided below the second heater 323. The air guide 327 may be arranged between the bottom surface 321*a*, which may be the bottom surface of the lower case 321, and the second heater 323 to block the bottom surface 321*a* from the second heater 323. The flames may not spread to the bottom surface 321*a* due to the air guide 327 serving as a blocking wall so that the flames generated by the combustion of the second heater 323 may be concentrated upward.

Meanwhile, a plurality of through holes 322 may be formed in the bottom surface 321*a* to pass through the bottom surface 321*a* which may be the bottom surface of the lower case 321. Also, a plurality of pass holes 328 may be formed in the air guide 327 to pass through the air guide 327 arranged at the upper portion of the bottom surface 321*a*.

The through holes 322 may form vertical paths in the bottom surface 321*a* so that outside air may flow into the lower case 321. Also, the pass holes 328 may form vertical paths in the air guide 327 and the external air introduced through the through hole 322 may flow toward the second heater 323. That is, paths for allowing the outside air to flow into the second heater 323 may be formed in the second heating assembly 320. The outside air introduced into the second heater 323 through the paths formed as described above may be used as secondary air for stable combustion in the second heater 323.

The through holes 322 and the pass holes 328 may be formed so that locations thereof are misaligned from each other in a vertical direction. When the through holes 322 and the pass holes 328 are arranged as such, a sufficient width of a path may be ensured so that the secondary air can be smoothly supplied to the second heater 323, and the blocking wall capable of blocking the flames from spreading toward the bottom surface 321*a* may be maintained.

Figure 6:
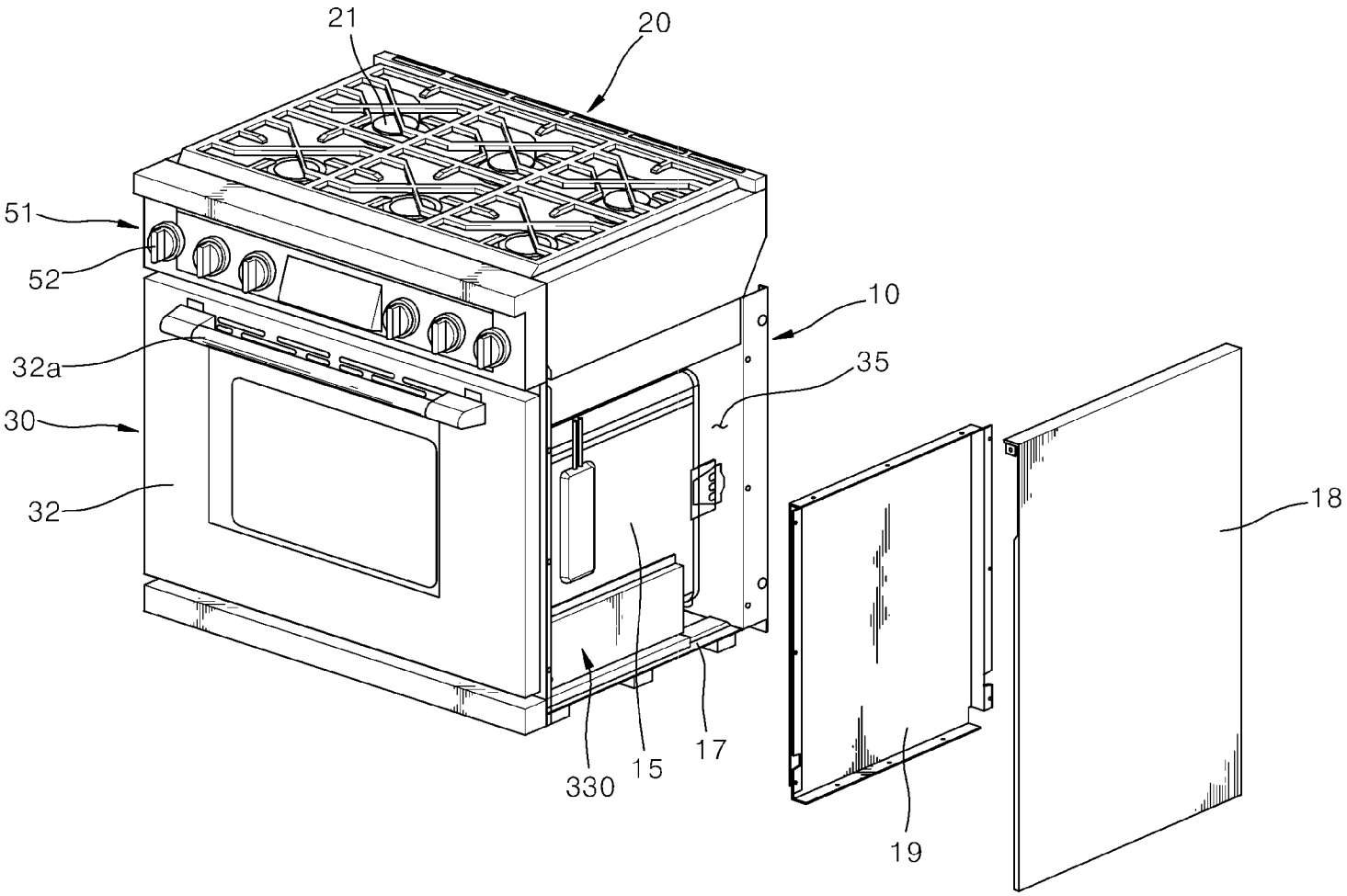
FIG. 6 is a perspective view illustrating a state in which a side panel is separated from the cooking appliance illustrated in FIG. 1.
Figure 7:
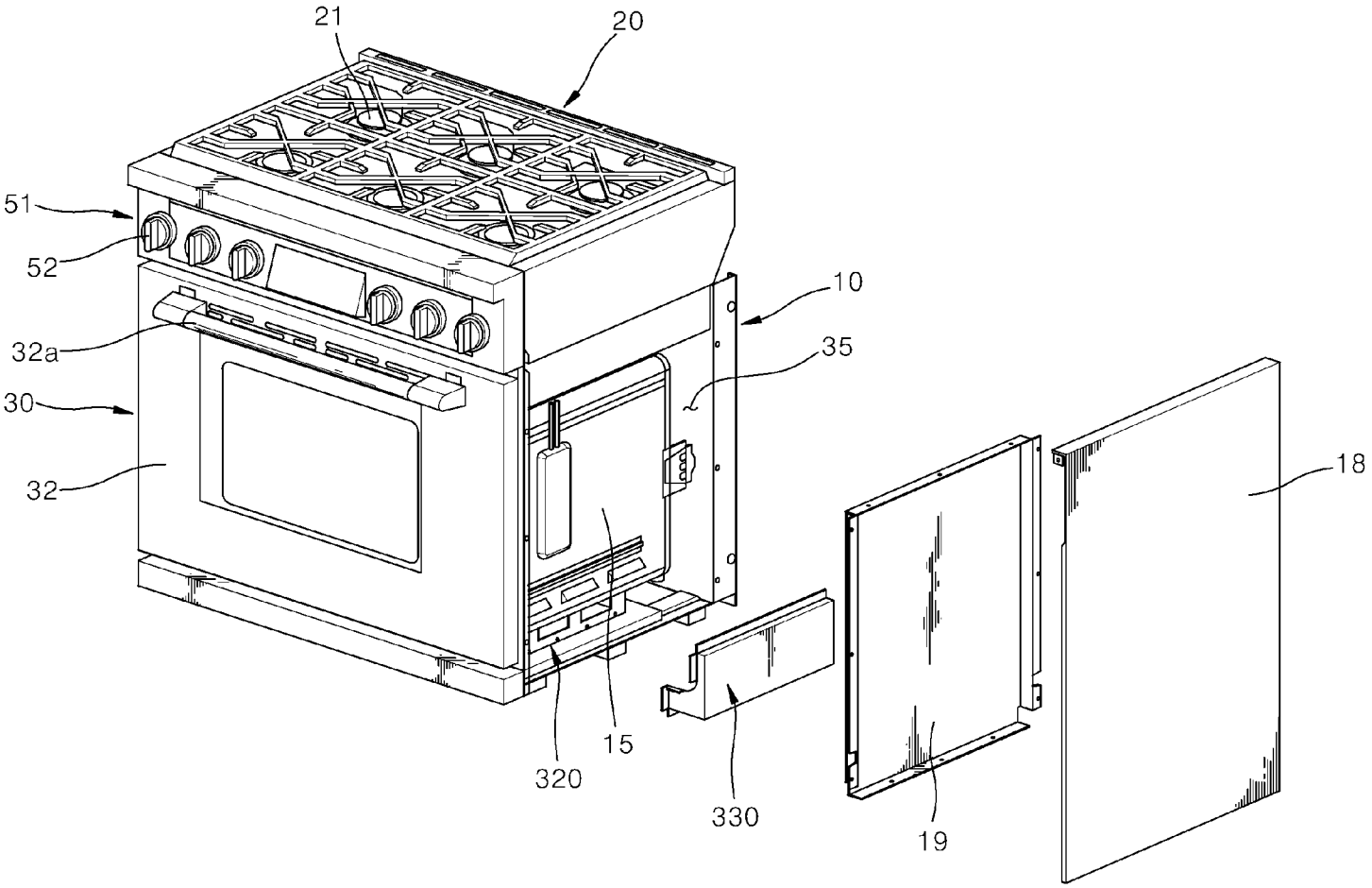
FIG. 7 is a perspective view illustrating a state in which a flow path connection member is separated from the cooking appliance illustrated in FIG. 6.
Figure 8:
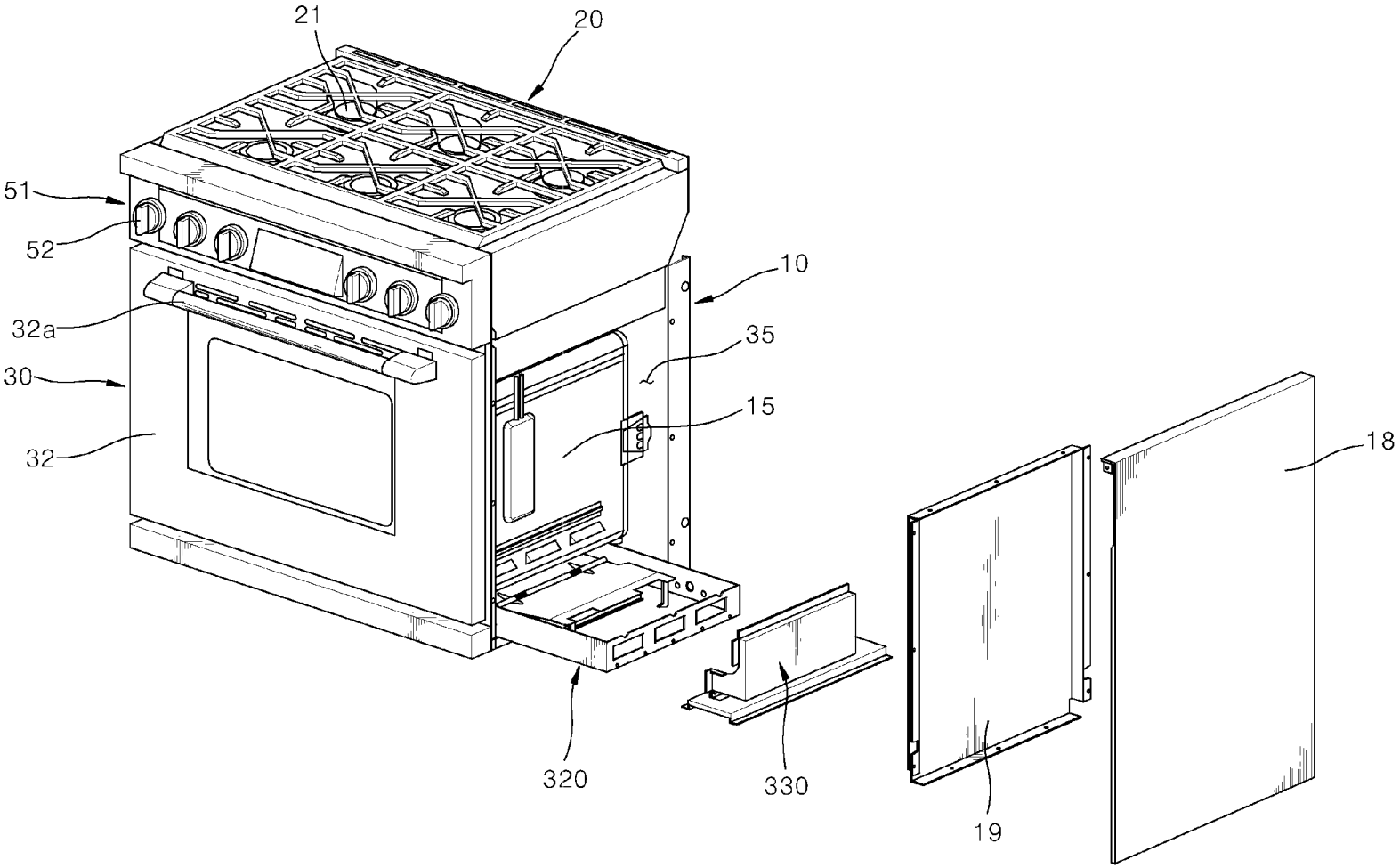
FIG. 8 is a perspective view illustrating a state in which a second heating assembly is partially withdrawn from the cooking appliance illustrated in FIG. 7.

FIG. 6 is a perspective view illustrating a state in which a side panel is separated from the cooking appliance illustrated in FIG. 1, FIG. 7 is a perspective view illustrating a state in which a flow path connection member is separated from the cooking appliance illustrated in FIG. 6, and FIG. 8 is a perspective view illustrating a state in which the second heating assembly is partially withdrawn from the cooking appliance illustrated in FIG. 7. Referring to FIGS. 5 and 6, the first heating assembly 310 provided inside the cooking chamber 31 may generate heat in the cooking chamber 31 and may generate a circulation flow of heat circulating in the cooking chamber 31, thereby allowing the heat to be uniformly transferred into the cooking chamber 31. The second heating assembly 320 may be provided at the lower portion of the outer side of the cooking chamber 31 to generate heat and may intensively heat a bottom surface of food so that the bottom surface of the food, such as pizza, becomes crispier.

That is, the cooking appliance of the embodiment may uniformly heat food in the cooking chamber 31 using the first heating assembly 310 and intensively heat a bottom surface of the food by using the second heating assembly 320. The cooking appliance of the embodiment may further provide a function of more quickly and effectively increasing a temperature in the cooking chamber 31 by transmitting heat generated in the second heating assembly 320 into the cooking chamber 31. Hereinafter, a heat transfer structure for implementing such a function will be described.

According to the embodiment, a first discharge port a may be formed in or at the side wall 321*b* which may be the side surface of the second heating assembly 320, and a second discharge port b may be formed in or at the side surface 15 which may be the side surface of the cooking chamber 31. The first discharge port a may pass through the side wall 321*b* in a lateral direction, and the first discharge port a may form a lateral path connecting the inside and outside of the lower case 321. The first discharge port a that passes through the side wall 321*b* may be a path which connects the inside of a lower case 321 where the second heater 323 is installed and the side space portion 35.

Also, the second discharge port b may pass through the side surface 15 in a lateral direction, and the second discharge port b may form a lateral path connecting the inside and outside of the cooking chamber 31. The second discharge port b that passes through the side surface 15 may serve as a path which connects the inside of the cooking chamber 31 and the side space portion 35.

Each of the first discharge port a and the second discharge port b may form a path to be connected to the side space portion 35. That is, the first discharge port a and the second discharge port b may form a path connecting the inside of the lower case 321 and the side space portion 35 and a path connecting the side space portion 35 and the inside of the cooking chamber 31. The cooking appliance of the embodiment may further include a flow path connection member 330.

The flow path connection member 330 may be installed on or at an outer side of the cooking chamber 31 and may form a lateral path through which heat generated in the second heating assembly 320 flows into the cooking chamber 31. The flow path connection member 330 may have a space formed therein in the form of a duct of which one side portion toward the cooking chamber 31 is open. The flow path connection member 330 may be provided on the outer side of the cooking chamber 31 and may include an outer wall surrounding the periphery of the first discharge port a and the second discharge port b. In the flow path connection member 330, a portion corresponding to a lower portion of the flow path connection member 330 may be arranged in the lower space portion 33, and the remaining portion corresponding to an upper portion of the flow path connection member 330 may be arranged in the side space portion 35.

An outer wall formed by the flow path connection member 330 and a flow path guide c surrounded by the side surface 15 and the lower surface 13 to which the flow path connection member 330 is coupled may be formed inside the flow path connection member 330. The flow path guide c formed in the inner space of the flow path connection member 330 may form a path that connects the first discharge port a and the second discharge port b. The flow path guide c may form a path passing through the lower space portion 33 and the side space portion 35, and may be defined by the flow path connection member 330 to be separated from the space formed in the lower space portion 33 and the side space portion 35.

That is, the flow path connection member 330 provided on the outer side of the cooking chamber 31 may form a path connecting the inside of the cooking chamber 31 and an inside of the second heating assembly 320 while passing through the lower space portion 33 and the side space portion 35. However, the flow path connection member 330 may form paths separated from spaces formed in the lower space portion 33 and the side space portion 35 in the lower space portion 33 and the side space portion 35. Thus, the cooking appliance of the embodiment may secure a path through which heat generated inside the second heating assembly 320 by combustion of the second heater 323 may be transferred into the cooking chamber 31 by convection.

A path (hereinafter, referred to as a "heat transfer path") through which the heat generated by the combustion of the second heater 323 may be transferred to the inside of the cooking chamber 31 by convection may be formed on the side portion of the cooking chamber 31 instead of the lower portion of the cooking chamber 31. When the heat transfer path is formed in the lower portion of the cooking chamber 31, a heat transfer path of the shortest distance in which the heat inside the second heating assembly 320 can be directly transferred into the cooking chamber 31 may be formed. However, in order for the heat transfer path to be formed in the lower portion of the cooking chamber 31, holes for allowing heat to pass therethrough may have to be formed in the lower surface 13 which may be the bottom surface of the cooking chamber 31.

In the structure in which the holes are formed in the lower surface 13, that is, the bottom surface of the cooking chamber 31, the bottom surface of the cooking chamber 31 may not maintain a smooth flat surface, and thus cleaning the bottom surface of the cooking chamber 31 may be difficult because contaminants may exist in the holes of the bottom surface of the cooking chamber 31. In addition, in the above structure, foreign substances may be dropped into the second heating assembly 320 through the holes and the second heating assembly 320 may become severely contaminated. As a result, the performance of the second heating assembly 320 may be degraded, and the number of accidents due to ignition of contaminants may increase.

In contrast, in the cooking appliance of the embodiment, the heat transfer structure may be formed such that the heat transfer path is not formed in the lower portion of the cooking chamber 31 and may be formed on the side portion of the cooking chamber 31. That is, in the embodiment, the inside of the second heating assembly 320 may open laterally through a first discharge port a, and the inside of the cooking chamber 31 may open laterally through a second discharge port b. As a result, a heat transfer path may be formed such that the flow path connection member 330 connects the two discharge ports a and b that open in the lateral direction.

Accordingly, the heat transfer path is may not directly pass through the bottom surface of the cooking chamber 31. Instead, the heat transfer path may be formed in a "⊏" shape that surrounds the lower surface and the side surface of the cooking chamber 31 from the outside of the cooking chamber 31 to bypass the cooking chamber 31, and may be connected to the inside of the cooking chamber 31 through a second discharge port b formed on the side surface of the cooking chamber 31.

In the heat transfer structure of the embodiment formed as described above, no holes may be formed in the bottom surface of the cooking chamber 31, and the bottom surface of the cooking chamber 31 may maintain a smooth flat surface.

Since the cooking appliance of the embodiment including the heat transfer structure may be implemented in a planar shape having a smooth and flat surface on the bottom surface of the cooking chamber 31, contaminants on the bottom surface of the cooking chamber 31 may be easily removed. These design elements may improve ease of cleaning and aesthetics inside the cooking chamber 31 and may appeal to consumers.

In addition, the cooking appliance of the embodiment including the above structure may prevent contaminants in the cooking chamber 31 from falling into the second heating assembly 320. As a result, the risk of degradation in performance or an accident of the second heating assembly 320 due to contamination may be reduced.

The flow path connection member 330 may be fixedly coupled to the main body 10 or may be detachably coupled to the main body 10. As illustrated in FIG. 7, in a case in which the flow path connection member 330 is detachably coupled to the main body 10, the second heating assembly 320 covered by the flow path connection member 330 may be exposed toward the side space portion 35 when the flow path connection member 330 is separated from the main body 10.

When the second heating assembly 320 is exposed to the side space portion 35, a lateral path may be created through which the second heating assembly 320 installed at the lower portion of the cooking chamber 31 may be separated from the main body 10. That is, when the flow path connection member 330 is detachably coupled to the main body 10, a second heating assembly 320 having a mounting structure in which the second heating assembly 320 may be separated from the main body 10 after separating the flow path connection member 330 from the main body 10, or the flow path connection member 330 and the second heating assembly 320 may be detachable from the main body 10, as shown in FIG. 8.

Figure 9:
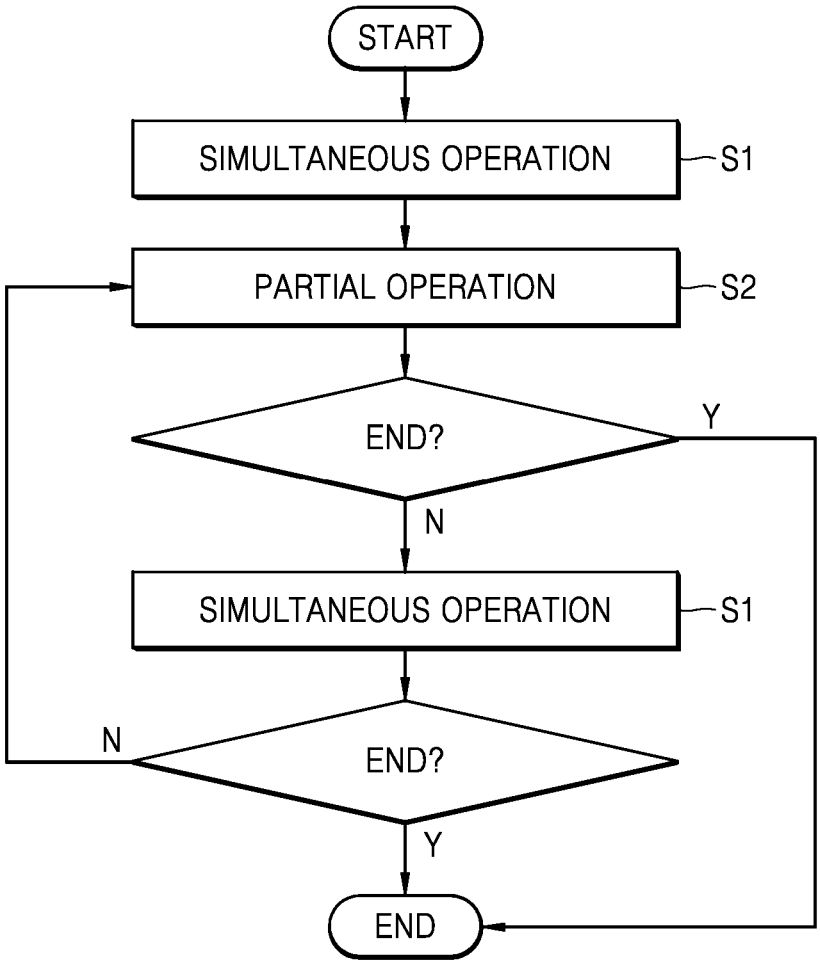
FIG. 9 is a flowchart illustrating a process of controlling combustion in a cooking appliance according to an embodiment.
Figure 10:
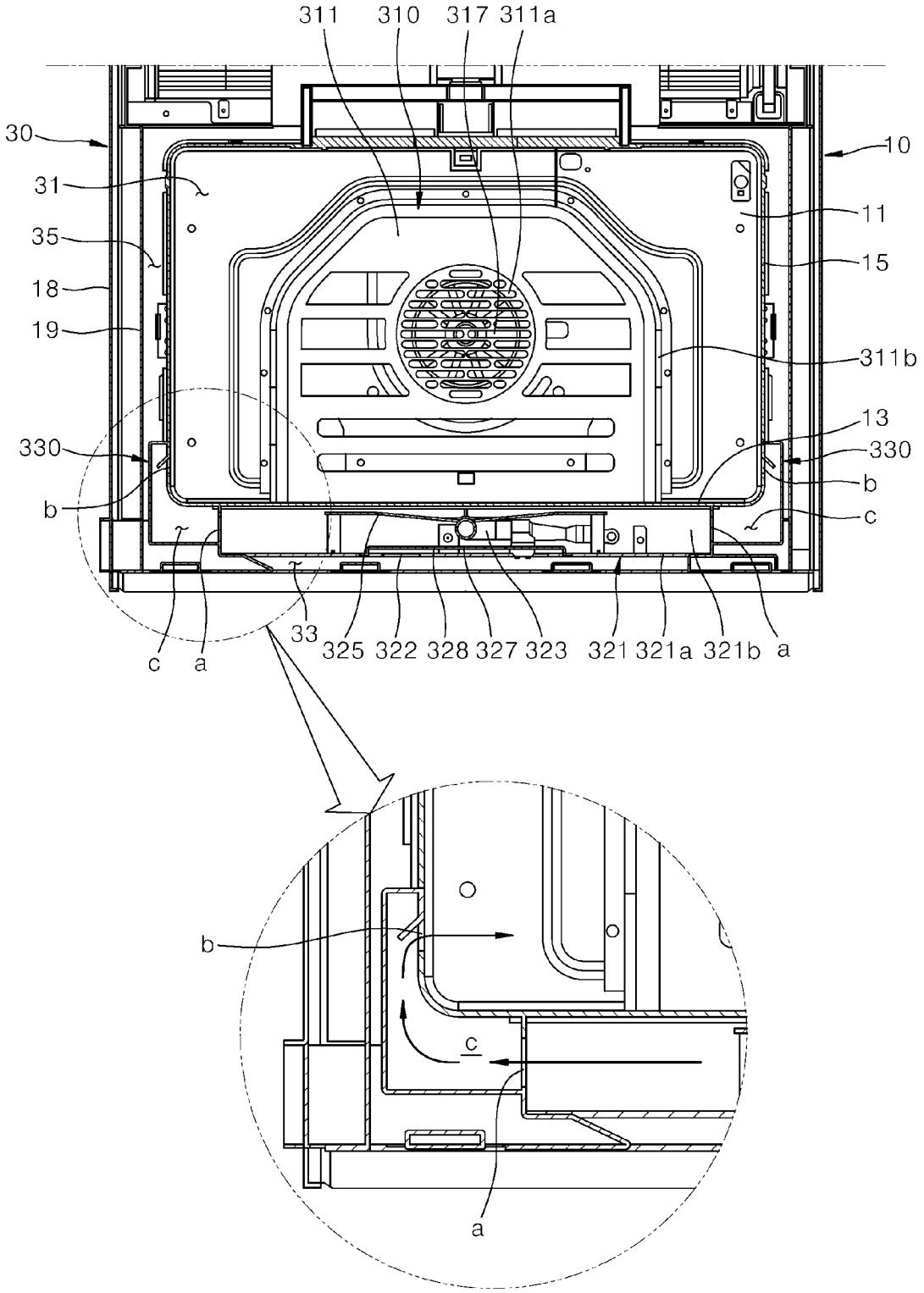
FIG. 10 is a view illustrating a flow of heat formed inside a cooking appliance according to an embodiment.

FIG. 9 is a flowchart illustrating a process of controlling combustion in a cooking appliance according to an embodiment. FIG. 10 is a view illustrating a flow of heat formed inside a cooking appliance according to an embodiment. Hereinafter, a method of controlling combustion in a cooking appliance according to an embodiment will be described with reference to FIGS. 9 and 10.

Referring, for example, to the embodiment of FIGS. 1-8 in order to explain the method of controlling combustion in a cooking appliance according to an embodiment, the oven 30 of the embodiment may have two heating assemblies therein, the first heating assembly 310 installed inside the cooking chamber 31, which may be one assembly of the two heating assemblies, may generate a circulation flow of heat circulating inside the cooking chamber 31, and the second heating assembly 320, which may be the other assembly, may generate heat from below the cooking chamber 31.

The cooking appliance of the embodiment having the above two heating assemblies may be operated in the following manner.

First, a simultaneous operation or step S1 in which the first heating assembly 310 and the second heating assembly 320 are simultaneously operated may be performed in an initial state in which no heating has been performed in a cooking chamber 31. In the simultaneous operation or step S1, combustion of the first heater 313 and combustion of the second heater 323 may be simultaneously performed. Accordingly, in the cooking chamber 31, a circulation flow of heat may be generated such that the heat is circulated in the cooking chamber 31 by an operation of the first heating assembly 310, and at the same time, a flow of the heat may also be generated so that the heat generated by an operation of the second heating assembly 320 is discharged from the side portion of the cooking chamber 31 through a flow path guide c formed inside a flow path connection member 330.

The heat discharged through the side portion of the cooking chamber 31, that is, through the second discharge port b, may then combine with the flow of the heat generated by the operation of the first heating assembly 310, that is, the circulation flow of the heat circulating inside the cooking chamber 31. Thus, the heat generated by a combustion operation of the first heating assembly 310 and the heat generated by a combustion operation of the second heating assembly 320 may be combined and circulated inside the cooking chamber 31, and thus a temperature in the cooking chamber 31 may be raised more quickly. That is, by simultaneously operating the first heating assembly 310 and the second heating assembly 320, the cooking appliance of the embodiment may quickly raise the temperature in the cooking chamber 31, thereby allowing the initial preheating of the cooking chamber to be performed more quickly and effectively, and shortening the time required for cooking food.

A second discharge port b configured to form a path on the cooking chamber 31 to discharge the heat generated by the combustion operation of the second heating assembly 320 may be formed on the side surface 15 and on the lower portion adjacent to the bottom surface of the cooking chamber 31. Accordingly, the heat generated by the second heating assembly 320 may be discharged into the cooking chamber 31 through the side portion of the cooking chamber 31 and may be discharged from the lower portion adjacent to the bottom surface of the cooking chamber 31 into the cooking chamber 31.

The above-described discharged heat may be combined with the circulation flow of the heat circulating inside the cooking chamber 31 and may be circulated in the entire cooking chamber 31. However, the heat discharged from the second heating assembly 320 may first flow along the bottom surface of the cooking chamber 31 before the discharged heat merges with the circulation flow of the heat circulating inside the cooking chamber 31, that is, the heat may flow along the bottom surface of the cooking chamber 31 immediately after being discharged into the cooking chamber 31 through the second discharge port b.

Therefore, the flow of heat flowing along the bottom surface of the cooking chamber 31 may be applied to food placed in the cooking chamber 31 together with the circulation flow of the heat circulating inside the entire cooking chamber 31. Thus, in addition to the heat circulating inside the entire cooking chamber 31, the heat flowing along the bottom surface of the cooking chamber 31 may be added to the bottom surface of the food. Furthermore, on the bottom surface of the food, not only the heat discharged through the second discharge port b but also heat transferred by convection through the bottom surface of the cooking chamber 31, that is, through the bottom surface heated by the combustion of the second heater 323, may be additionally transferred.

Thus, concentrated heating may be achieved so that a relatively high amount of heat may be applied to the bottom surface of the food in comparison with that applied to other portions of the food. That is, by using the operation control of simultaneously operating the first heating assembly 310 and the second heating assembly 320, the cooking appliance of the embodiment may provide not only a function of rapidly raising a temperature in the cooking chamber 31 while uniformly heating the entire cooking chamber 31, but also a function of concentrated heating on a bottom surface of food.

After the above-described simultaneous operation or step S1 proceeds to a point set by the simultaneous operation or step S1, a partial operation or step S2 may be performed so that only one of the first heating assembly 310 and the second heating assembly 320 is operated.

As an example, the partial operation or step S2 may be performed so that only the first heating assembly 310 is operated. Accordingly, in the cooking chamber 31, heating in which only the circulation flow of the heat circulating inside the cooking chamber 31 is generated by the operation of the first heating assembly 310 may be performed, and heating in which the heat generated by the second heating assembly 320 is discharged through the side portion of the cooking chamber 31 may be stopped.

The partial operation or step S2 may be selected when there is a relatively low need for concentrated heating on the bottom surface of the food but it is still necessary to uniformly cook the entire food. That is, the cooking appliance according to the embodiment may cook the food so that the simultaneous operation or step S1 is first performed to quickly raise the temperature in the cooking chamber 31 to a temperature suitable for cooking the food and then the partial operation or step S2 may be performed to operate only the first heating assembly 310. Thus, the entire food may be uniformly heated and cooked while effectively shortening the time required for cooking the food.

As another example, the partial operation or step S2 may be performed so that only the second heating assembly 320 is operated. Accordingly, in the cooking chamber 31, only heating in which the heat generated in the second heating assembly 320 is discharged through the side portion of the cooking chamber 31 may be performed, and heating by the operation of the first heating assembly 310 may be stopped.

The partial operation or step S2 performed as described above may be used in the case of cooking food, such as a pizza, that requires concentrated heating on the bottom surface of the food. That is, the cooking appliance according to the embodiment may cook the food so that the simultaneous operation or step S1 is first performed to quickly raise the temperature in the cooking chamber 31 to a temperature suitable for cooking the food and then the partial operation or step S2 may be performed to operate only the second heating assembly 320 when a temperature in the cooking chamber 31 required for cooking food is maintained for some time. Thus, applying concentrated heating to the bottom surface of the food may be more effectively provided so that the bottom surface of the food, such as pizza, may be cooked to be more crispy.

Also, during a simultaneous operation of the first heating assembly 310 and the second heating assembly 320, airflow formed by the operation of the convection fan 317 may affect combustion in the second heater 323, and thus a problem may occur wherein the combustion in the second heater 323 may become unstable, for example, a flame formed in the second heater 323 may shake or complete combustion in the second heater 323 may not be suitably performed. The cooking appliance of the embodiment may switch the combustion operation to the partial operation or step S2 at the time when the combustion of the second heater 323 becomes unstable while the simultaneous operation step S1 is performed, thereby stopping the operation of the first heating assembly 310 and allowing only the operation of the second heating assembly 320 to proceed. Thus, the cooking appliance may prevent the airflow formed by the operation of the convection fan 317 from affecting the combustion in the second heater 323, and thereby the combustion of the second heater 323 may be stabilized. Thus, the cooking appliance may prevent degradation in heating performance of the cooking appliance.

As another example, in the partial operation or step S2, the operation of the first heating assembly 310 and the operation of the second heating assembly 320 may be alternately performed. In the partial operation or step S2 operated as described above, a process in which an operation of one assembly of the first heating assembly 310 and the second heating assembly 320 is first performed and then an operation of the other assembly is performed may be repeatedly performed.

In the cooking appliance according to the embodiment in which the partial operation or step S2 is performed as described above, a uniform heating function for entire food and a concentrated heating function for a part of the food may be effectively provided at the same time while the operation of the first heating assembly 310 minimally affects the combustion of the second heating assembly 320. As another example, in the cooking appliance of the embodiment, the operation control of the first heating assembly 310 and the second heating assembly 320 may be performed so that the simultaneous operation or step S1 and the partial operation step S2 are alternately performed.

Accordingly, the inside of the cooking chamber 31 may be heated so that the partial operation or step S2 proceeds after the simultaneous operation step S1 has proceeded for a set time, and the process of alternately performing the simultaneous operation or step S1 and the partial operation or step S2 may be repeatedly performed.

The control of operating the first heating assembly 310 and the second heating assembly 320 may be performed so that the point in time when the simultaneous operation step S1 switches to the partial operation or step S2 is dependent on a temperature inside the cooking chamber 31.

For example, operating the first heating assembly 310 and the second heating assembly 320 may be performed so that the partial operation or step S2 is performed when the temperature inside the cooking chamber 31 reaches a set temperature while the simultaneous operation or step S1 is performed. When the combustion operation of the cooking appliance is controlled as described above, the simultaneous operation or step S1 may be performed to quickly raise the temperature of the cooking chamber 31 to the set temperature, and the partial operation or step S2 may be performed to change the temperature of the cooking chamber 31 so that unnecessary consumption of energy can be reduced. Thus, it may be possible to effectively reduce the time required for cooking food while reducing the unnecessary consumption of energy.

Also, when the partial operation or step S2 is performed so that the operation of the first heating assembly 310 is stopped and only the operation of the second heating assembly 320 is performed, the second heater 323 may burn stably.

The cooking appliance and the combustion control method thereof according to the embodiment may not only effectively shorten the time required for cooking food while reducing unnecessary consumption of energy, but also may provide a uniform heating function that uniformly cooks the entire food by uniformly heating the entire cooking chamber 31 together with a function of applying concentrated heating to the bottom surface of the food.

A cooking appliance and combustion control method of a cooking appliance according to embodiments may effectively shorten the time required for cooking while reducing unnecessary consumption of energy, and may provide a uniform heating function capable of uniformly cooking entire food by uniformly heating an entire cooking chamber together with a function of applying concentrated heat to the bottom surface of the food. Embodiments are directed to providing a cooking appliance and combustion control method of a cooking appliance capable of effectively shortening a cooking time as well as providing a uniform heating function and a concentrated heating function.

A cooking appliance according to embodiments may include a main body having a cooking chamber formed therein, a first heating assembly provided inside the cooking chamber to generate heat, a second heating assembly provided outside the cooking chamber to generate heat from under the cooking chamber, and a flow path connection member configured to form a lateral path through which the heat generated in the second heating assembly is introduced into the cooking chamber through a side portion of the cooking chamber. The main body may include a discharge port configured to form a path through which an inside of the cooking chamber communicates with an outside of the cooking chamber, and the flow path connection member may form a path connecting an inside of the second heating assembly and the discharge port.

The main body may further include a lower space portion formed at a lower portion of the main body to form a space separated from the cooking chamber under the cooking chamber and a side space portion formed at a side portion of the main body to form a space separated from the cooking chamber beside the cooking chamber. The discharge port may pass through a side surface of the cooking chamber and may form a path connecting the inside of the cooking chamber and the side space portion. The flow path connection member may be arranged in the lower space portion and the side space portion and may form a path inside the flow path connection member to connect the inside of the second heating assembly and the discharge port. The path formed in the flow path connection member may be defined by the flow path connection member to be separated from the spaces formed in the lower space portion and the side space portion.

The first heating assembly may include a fan cover provided on a rear side of the main body to form a divided space inside the cooking chamber and provided with an suction port and a discharge port, a first heater installed in a space inside the fan cover to generate heat, a convection fan configured to generate an air circulation flow in which air heated by the fan cover, into which air in the cooking chamber is introduced through the suction port, is discharged to the cooking chamber through the discharge port. The heat discharged through the discharge port may be combined with the air circulation flow generated by the first heating assembly, and may circulate inside the cooking chamber.

The second heating assembly may include a lower case installed in the lower space portion and having an accommodation space formed therein, and a second heater installed inside the lower case to generate heat from under the cooking chamber.

The lower case may include a first discharge port configured to form a path connecting an inside and outside of the lower case and formed to pass through the lower case. The main body may include a second discharge port that forms a path that allows the inside and the outside of the cooking chamber to communicate with each other. The flow path connection member may form a path connecting the first discharge port and the second discharge port.

A method of controlling a combustion operation of a cooking appliance according to embodiments may include a main body having a cooking chamber formed therein, a first heating assembly provided inside a cooking chamber to generate an air circulation flow to circulate heated air inside the cooking chamber, and a second heating assembly provided outside the cooking chamber to generate heat from under the cooking chamber may include a simultaneous operation step, in which the first heating assembly and the second heating assembly are simultaneously operated, and a partial operation step in which only one heating assembly of the first heating assembly and the second heating assembly is operated. The simultaneous operation step and the partial operation step may be performed alternately.

In the partial operation step, an operation of the first heating assembly and an operation of the second heating assembly may be alternately performed. The partial operation step may proceed after the simultaneous operation step has proceeded for a set time, and the point in time when the simultaneous operation step switches to the partial operation step may depend on a temperature inside the cooking chamber.

The cooking appliance may include the flow path connection member configured to form a path through which air heated by the heat generated in the second heating assembly is introduced into the cooking chamber through a side portion of the cooking chamber. When the second heating assembly operates, air heated by the heat generated in the second heating assembly may be discharged into the cooking chamber through the flow path connection member.

While the above disclosure has been described with reference to the exemplary embodiments illustrated in the accompanying drawings, it should be understood that the disclosure is not limited to the disclosed embodiments, but is intended to cover various modifications and equivalent arrangements included within the sprit and scope of the appended claims. Accordingly, the scope shall be determined only according to the attached claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a main body having a cooking chamber formed therein;

a first heating assembly including a first heater provided inside the cooking chamber and configured to generate heat;

a second heating assembly including a second heater provided outside the cooking chamber and configured to generate heat under the cooking chamber;

a flow path connection member configured to form a path through which the heat generated in the second heating assembly is introduced into the cooking chamber through a side portion of the cooking chamber; and a first discharge port which allows an inside of the cooking chamber to communicate with an outside of the cooking chamber formed in the main body, wherein the path formed by the flow path connection member connects an inside of the second heating assembly and the first discharge port, wherein the main body further includes:

a lower space formed under the main body and separated from the cooking chamber; and a side space formed at a side of the main body and separated from the cooking chamber, wherein the first discharge port passes through a side surface of the cooking chamber, wherein the flow path connection member connects the inside of the second heating assembly and the first discharge port, and wherein the path formed in the flow path connection member is separated from the lower space and the side space.

2. The cooking appliance of claim 1, wherein the first heating assembly includes:

a fan cover provided at a rear side of the main body to form a divided space inside the cooking chamber and including a suction port and a second discharge port;

the first heater which is installed in a space inside of the fan cover and configured to generate heat; and a convection fan configured to generate an air circulation flow in which air introduced through the suction port is discharged to the cooking chamber through the second discharge port.

3. The cooking appliance of claim 2, wherein the heat discharged through the first discharge port is combined with the air circulation flow generated by the first heating assembly and circulates inside the cooking chamber.

4. The cooking appliance of claim 2, wherein the second heating assembly includes:

a lower case installed in the lower space and including an accommodation space formed therein; and the second heater which is installed inside of the lower case and configured to generate heat from under the cooking chamber.

5. The cooking appliance of claim 4, wherein the lower case includes a third discharge port configured to allow an inside of the lower case to communicate with an outside of the lower case and pass through the lower case and the flow path connection member connects the first discharge port with the third discharge port.

6. A cooking appliance, comprising:

a main body having a cooking chamber formed therein;

a first heating assembly including a first heater and a convection fan provided inside the cooking chamber and configured to generate heat;

a second heating assembly including a second heater provided in a case provided outside the cooking chamber and configured to generate heat under the cooking chamber; and a flow path through which the heated air generated in the second heating assembly is introduced into the cooking chamber through a side of the cooking chamber; and a first discharge port which allows an inside of the cooking chamber to communicate with an outside of the cooking chamber formed in the main body, wherein the flow path connects an inside of the second heating assembly and the first discharge port, wherein the main body further includes:

a lower space formed under the main body and separated from the cooking chamber; and a side space formed at a side of the main body and separated from the cooking chamber, wherein the first discharge port passes through a side surface of the cooking chamber, wherein a flow path connection member connects the inside of the second heating assembly and the first discharge port, and wherein the path formed in the flow path connection member is separated from the lower space and the side space.

7. The cooking appliance of claim 6, wherein the case includes a second discharge port, and the flow path is provided between the first discharge port and the second discharge port.

8. The cooking appliance of claim 7, wherein the flow path connection member is attached to the cooking chamber and the case and encloses the first discharge port and the second discharge port.

9. The cooking chamber of claim 8, wherein the convection fan is provided in a fan cover, and the fan cover includes a suction port and a third discharge port, wherein air is sucked into the fan cover by the convection fan, heated by the first heater, and discharged into the cooking chamber through the third discharge port.

10. The cooking chamber of claim 9, wherein the heated air discharged through the third discharge port is mixed with the heated air discharged through the second discharge port inside the cooking chamber.

11. The cooking chamber of claim 10, wherein the flow path connection member includes a first duct section that surrounds the first discharge port and a second duct section that surrounds the second discharge port.

* * * * *